US006360378B2

(12) United States Patent
Martin

(10) Patent No.: US 6,360,378 B2
(45) **Date of Patent: *Mar. 26, 2002**

(54) PRESSURIZED WATER CLOSET FLUSHING SYSTEM

(75) Inventor: Raymond Bruce Martin, Bloomfield Hills, MI (US)

(73) Assignee: W/C Technology Corporation, Farmington Hills, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/496,091

(22) Filed: Feb. 1, 2000

Related U.S. Application Data

(63) Continuation of application No. 08/457,162, filed on Jun. 1, 1995, now abandoned, which is a continuation of application No. 08/265,695, filed on Jun. 24, 1994, now abandoned, which is a continuation of application No. 08/046,216, filed on Apr. 8, 1993, now abandoned.

(51) Int. Cl.[7] ..... E03D 3/10
(52) U.S. Cl. ..... 4/359; 4/354; 4/362
(58) Field of Search ..... 4/354, 359, 361, 4/362

(56) References Cited

U.S. PATENT DOCUMENTS 1,292,313 A * 1/1919 Handy ..... 4/359
1,440,827 A * 1/1923 Handy ..... 4/359
1,636,402 A * 7/1927 Welcker ..... 4/359
3,820,754 A * 6/1974 Caron et al. ..... 4/359 X
5,435,019 A * 7/1995 Badders ..... 4/359

FOREIGN PATENT DOCUMENTS

AT 60693 * 8/1913 ..... 4/359

* cited by examiner

*Primary Examiner*—Robert M. Fetsuga
(74) *Attorney, Agent, or Firm*—Dinnin & Dunn, P.C.

(57) ABSTRACT

A pressurized water closet operating system comprises an accumulator vessel for storing water and air under pressure. A flush valve controls the discharge of water from the vessel and comprises a cylinder having a lower end in fluid communication with the outlet of said vessel, a piston defining upper and lower chambers therein, an orifice in the piston, an aperture in the cylinder providing fluid communication between the interior of the accumulator vessel and the lower chamber in the cylinder, a valve on the piston normally closing the lower end of the cylinder so as to close the water outlet and openable upon upward movement of the piston to permit the discharge of water, and a normally closed flush valve actuator openable to effect fluid communication between ambient air pressure and the upper chamber in the cylinder whereby a fluid pressure differential across said piston effects upward movement thereof and opening of the valve.

2 Claims, 3 Drawing Sheets

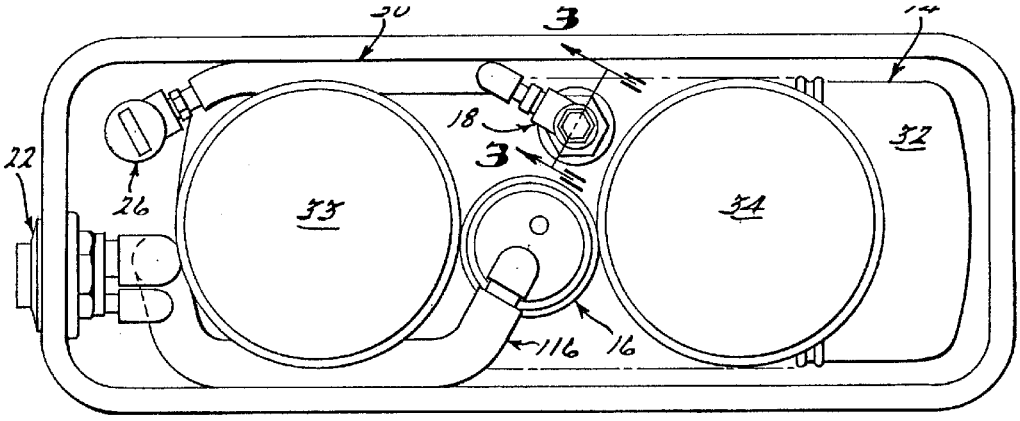
FIG. 2.
FIG. 4.
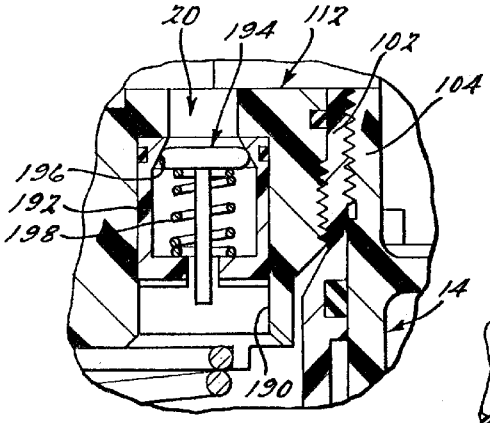
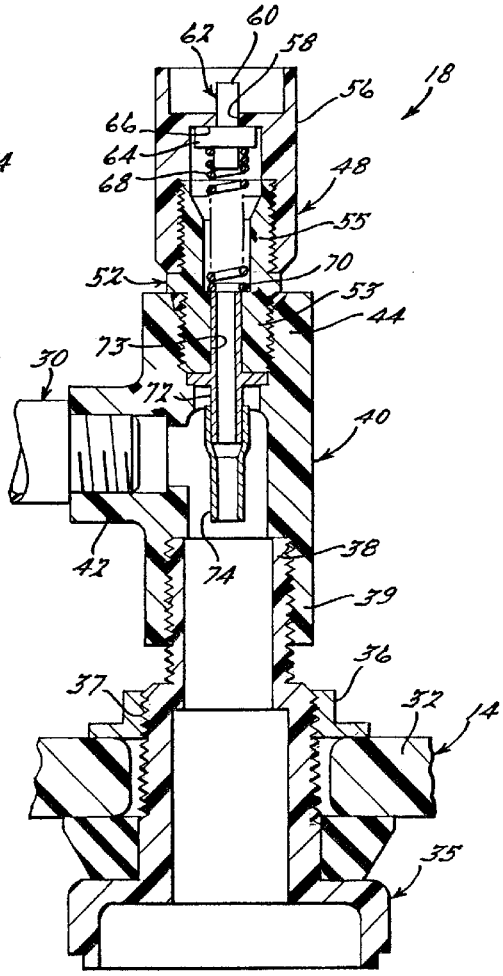
FIG. 3.
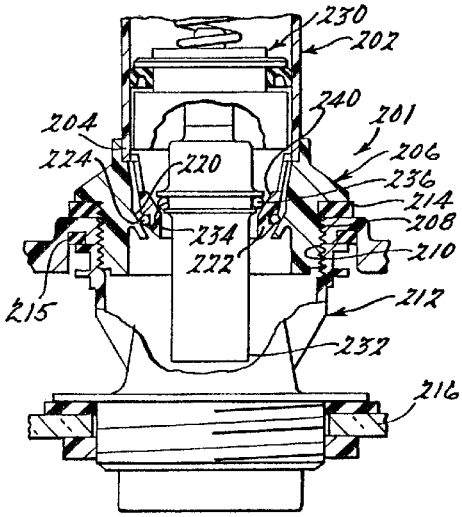
FIG. 6.

PRESSURIZED WATER CLOSET FLUSHING SYSTEM

This application is a continuation of Ser. No. 08/457,162 Jun, 1, 1995 abandoned which is a continuation of Ser. No. 08/265,695 Jun. 24, 1994 abandoned which is a continuation of Ser. No. 08/046,216 Apr. 8, 1993 abandoned.

BACKGROUND OF THE INVENTION

1. Field of the Invention

The present invention relates to a pressurized water closet flushing system that minimizes water usage incident to flushing of a toilet yet maximizes the efficiency of effluent transport.

2. Related Art

The herein disclosed pressurized water closet flushing system represents an improvement over the system disclosed in my U.S. Pat. No. 4,233,698 issued Nov. 18, 1980 and is a continuation of my application Ser. No. 08/457,162, filed Jun. 1, 1995 abandoned.

Water conservation is an environmental problem that has resulted in strict controls being placed on domestic water usage in many areas of the country. Pressurized water closet flushing systems make a significant contribution to water conservation in that they exhibit relatively low water consumption coupled with high effluent transport efficiency. Known systems generally consist of a water supply group, an accumulator vessel, a flush valve and a flush control. The aforesaid components are generally installed internally of a water closet and are energized by water pressure from a fresh water supply system.

A complete flush cycle consists of a water fill phase and a water discharge phase. In the fill phase of the cycle, supply system pressure forces the water into the accumulator vessel. As the water level rises in the accumulator vessel, air contained therein is compressed. When the pressure of the compressed air in the accumulator vessel equals that of the fresh water supply, flow of water into the accumulator vessel ceases and the system is conditioned for the water discharge phase of operation. When the flush control is actuated, the water discharge phase commences and the compressed air in the accumulator vessel pushes the stored water into the water closet bowl at high velocity, flushing waste therefrom with minimum water consumption.

The function of the accumulator vessel is to store both water and potential energy in the form of compressed air. For a given line pressure, the volume of the accumulator vessel determines the maximum discharge energy available.

SUMMARY OF THE INVENTION

The water closet flushing system of the present invention exhibits a substantial increase in discharge energy over known systems without a corresponding increase in water consumption. Discharge energy is maximized by increasing the volume and therefore the total potential energy of the compressed air charge above the water in the accumulator vessel while water consumption is minimized by positive closing of an improved flush valve.

The improved flush valve features a novel balanced piston that divides a flush valve cylinder into upper and lower chambers. As water enters the accumulator vessel, in the fill phase of the flush cycle, compressed air flows from the lower chamber defined by the piston through an air transfer orifice in the piston into an upper chamber of the cylinder above the piston. The fill phase of the cycle continues until a pressure balance is achieved between pressure in the accumulator and line pressure. The flush control is connected to the upper chamber of the flush valve cylinder. When the flush control is opened, the water discharge phase of the flush cycle is initiated by venting the compressed air in the upper chamber of the cylinder creating a pressure differential across the piston allowing the piston and flush valve thereon to move upwardly allowing water in the accumulator vessel to be discharged at high velocity into the water closet bowl.

Closing or downward movement of the flush valve piston is initially resisted by a partial vacuum that is created within the upper chamber of the cylinder above the piston due to initial downward movement thereof. The flush valve piston remains suspended with the flush valve thereon in the open condition until sufficient air passes from the accumulator to the lower chamber of the flush valve cylinder thence upwardly through the transfer orifice in the piston into the upper chamber of the cylinder to reduce the pressure differential across the piston, allowing the flush valve piston and flush valve to return to the closed position under the bias of the flush valve return spring.

The aforesaid operation of the flush valve is insured by an improved air induction system that provides for replenishment of air lost in each flush cycle and lost due to absorption of air into the stored water. Moreover, the air induction system is self-limiting and the accumulator vessel cannot be overcharged with air, e.g., become "air-logged."

In accordance with yet another feature, an improved vacuum breaker acts as a safety device that precludes contaminated water in the toilet bowl from being siphoned into the accumulator vessel and then into the fresh water system. In the event that a negative pressure develops within the fresh water supply system resulting in a relatively higher pressure in the accumulator vessel than in the water supply system, water contained within the vessel will flow backwards reducing the pressure within the vessel. When the internal pressure within the vessel falls below ambient pressure, the vacuum breaker valve will open and admit outside air into the vessel breaking the vacuum and precluding waste from the water closet bowl from being pulled into the vessel. Placement of the vacuum breaker above the flush valve piston precludes creation of a vacuum above the piston in the event air in the accumulator vessel is fully expanded which could restrict proper closure of the flush valve.

Advantages of the herein disclosed system over prior systems are greater operational reliability, higher efficiency and lower manufacturing cost.

BRIEF DESCRIPTION OF THE DRAWINGS

FIG. 2 is a view taken in the direction of the arrow "2" of FIG. 1;

FIG. 3 is a view taken along the line 3—3 of FIG. 2.

FIG. 4 is a view taken within the circle "4" of FIG. 1;

FIG. 6 is a fragmentary view of a modified flush valve assembly.

DETAILED DESCRIPTION OF THE PREFERRED EMBODIMENT(S)

Figure 1:
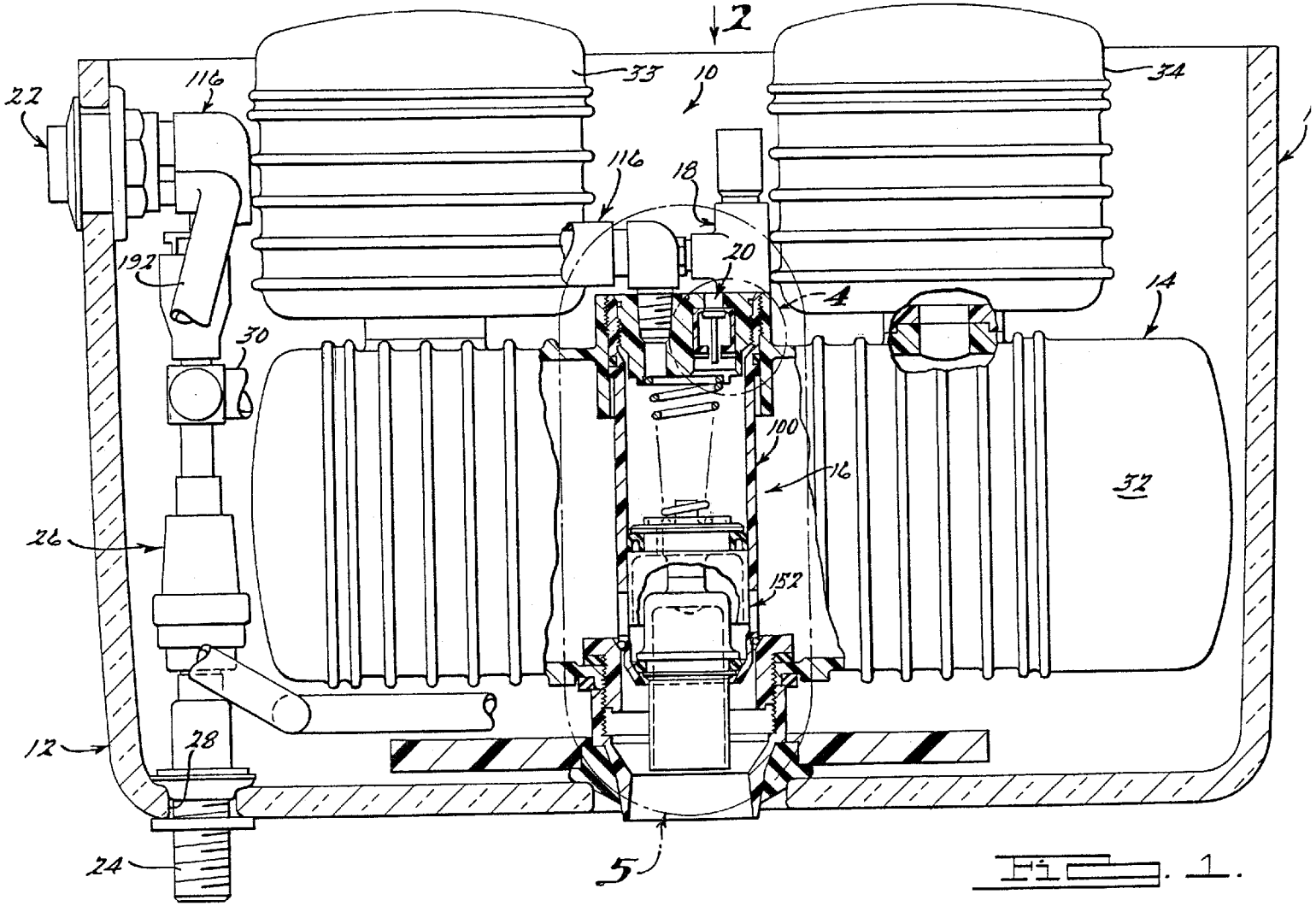
FIG. 1 is an elevational view, partially in section of an improved pressurized water closet flushing system in accordance with the present invention.

Referring to FIG. 1 of the drawings, a pressurized water closet flushing system 10, in accordance with a preferred and constructed embodiment of the present invention, is shown in operative association with a conventional water closet tank 12. Major components of the system 10 are an accumulator vessel 14, a flush valve assembly 16, a water inlet and air induction assembly 18, a vacuum breaker assembly 20, and a manual flush control valve 22.

Water is supplied to the flushing system 10 from a pressurized source (not shown) through a conventional externally threaded inlet stem 24 of a water inlet tube 26. The inlet stem 24 is disposed in a complementary aperture 28 in the water closet tank 12. Water flows upwardly without restriction through the tube 26 thence laterally through a line 30 (FIG. 2) to the water inlet and air induction assembly 18 which is mounted on the accumulator vessel 14.

The accumulator vessel 14 is of a size and configuration dictated by energy requirements and of a configuration dictated by space requirements associated with connection to the bowl of the system 10. In the constructed embodiment disclosed, the accumulator vessel 14 comprises a cylindrical horizontally orientated primary tank 32 and a pair of top mounted auxiliary tanks 33 and 34.

As best seen in FIG. 3, the water inlet and air induction assembly 18 is mounted on the primary tank 32 of the accumulator vessel 14. A flanged mounting nipple 35 is retained by a nut 36 that is accepted on a complementary externally threaded section 37 of the mounting nipple 35. The mounting nipple 35 also has an externally threaded upstanding portion 38 for the acceptance of a complementary internally threaded leg 39 on a T-shaped water inlet fitting 40. The water inlet fitting 40 has an internally threaded stem portion 42 that accepts the line 30 from the water inlet tube 26 as well as an internally threaded upstanding leg portion 44 that accepts an air induction valve system generally designated by the numeral 48. It is to be understood that system water is free to pass through the tube 26, line 30, T-shaped inlet fitting 40, and mounting nipple 35 at all times under system pressure.

In accordance with one feature of the present invention, the air induction system 48 is operative in the fill phase of the flush cycle and comprises a mounting insert 52 having an externally threaded lower stem portion 53 that is accepted in the complementary internally threaded leg portion 44 of the T-shaped inlet fitting 40. The insert 52 has a threaded upper stem portion 55 that accepts a complementary internally threaded cap 56. The cap 56 has an aperture 58 therein for the acceptance of a stem 60 of an air induction valve 62. The valve 62 has a radially extending flange 64 thereon which is normally seated against a complementary seat 66 on the cap 56. The valve 62 is normally biased to the closed position by water pressure within the system. When pressure is reduced as by flow into the accumulator 14, valve 62 is free to open. A spring 68 merely acts as a spacer to position the air induction valve 62, yet permits free movement thereof when a pressure differential is created thereacross due to inlet flow of water.

A tube 72 extends downwardly through a central passage 73 in the insert 52 for the support of a tube extension 74. Since the end of the tube extension 74 opens in the direction of water flow into the accumulator vessel 14, the venturi effect of the water flow creates local air pressure differential across the valve 62 which biases the valve 62 to the open condition as long as external air pressure is greater than air pressure at the tip of the tube extension 74. When the aforesaid pressure differential exists, air is drawn into the inflowing water stream, replenishing air in the accumulator vessel 14 in a self regulating manner.

Figure 5:
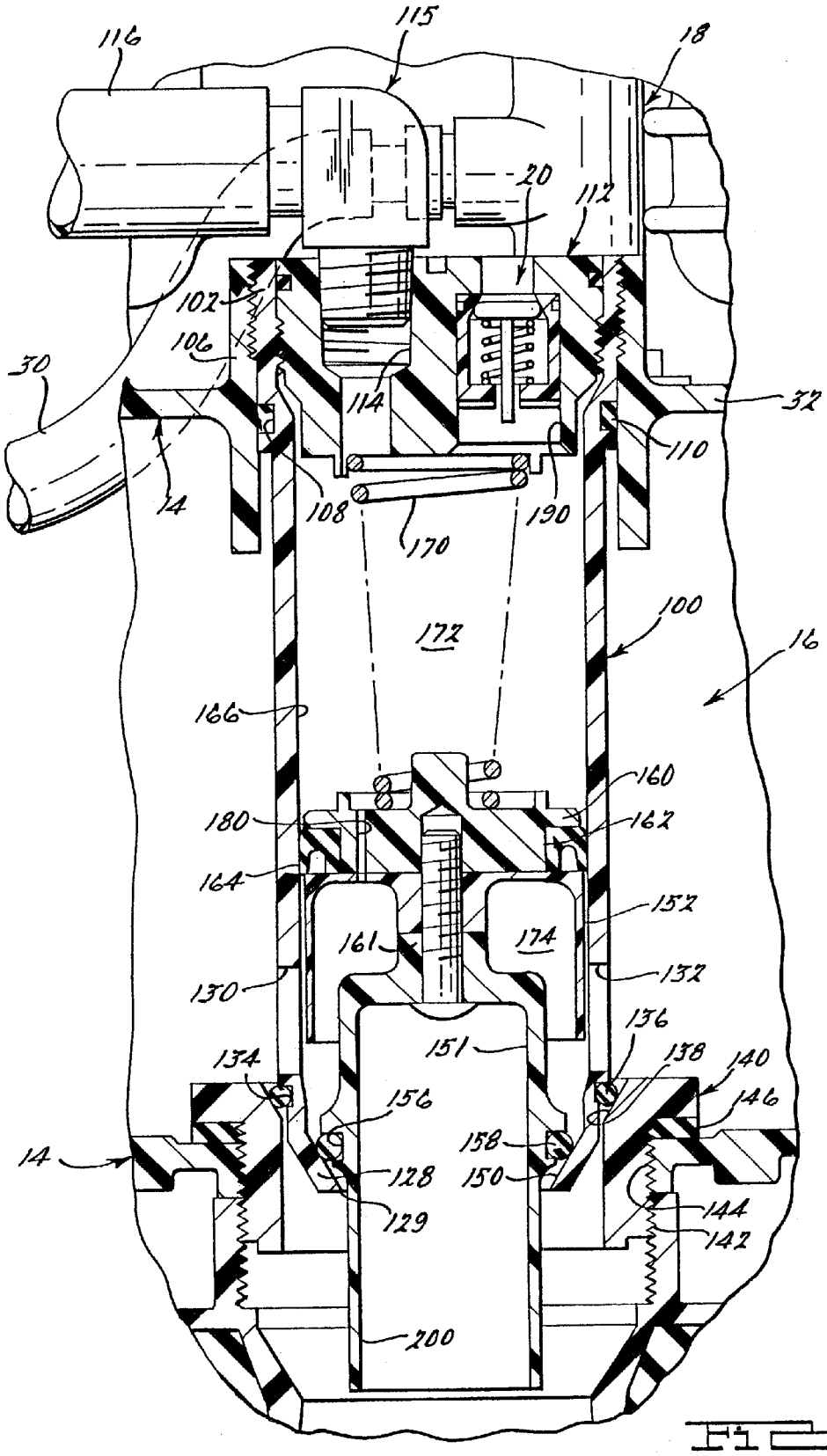
FIG. 5 is an enlarged cross-sectional view taken within the circle "5" of FIG. 1.

In accordance with another feature of the invention, and as best seen in FIG. 5 of the drawings, the flush valve assembly 16 comprises a vertically oriented flush valve cylinder 100 having an externally threaded upper end portion 102 that is accepted in a complementary internally threaded flange 106 on the primary tank 32 of the accumulator vessel 14. The flush valve cylinder 100 is provided with an annular seal groove 108 for the acceptance of an annular seal 110 that effects a seal between the cylinder 100 and flange 106 of the accumulator vessel 14. It is to be noted that the flush valve assembly 16 is removable as a complete assembly from the accumulator vessel 14 by simply rotating the cylinder 100 relative to the accumulator vessel 14 thereby to effect relative vertical movement and release.

The flush valve cylinder 100 is provided with an externally threaded upper end cap 112 that is accepted in complementary internal threads in the upper end portion 102 of the cylinder 100. The end cap 112 has an internally threaded bore 114 for the acceptance of the nipple of an externally threaded elbow 115. A tube 116 connects the elbow 115 to the manually operable flush control valve 22 to facilitate flushing of the system 10, as will be described.

A lower end portion 128 of the cylinder 100 is provided with a pair of apertures 130 and 132 for the admission of air and water into the interior of the flush valve cylinder 100. The apertures 130 and 132 are disposed immediately above an annular groove 134 in the cylinder 100—which accepts an O-ring 136. The O-ring 136 is seated on a complementary conical seat 138 on a flush valve bushing 140. The bushing 140 has an externally threaded portion 142 that is accepted in a complementary internally threaded aperture 144 in the primary tank 32 of the accumulator vessel 14. A suitable gasket 146 affects a seal between the bushing 140 and accumulator vessel 14.

The lower end portion 128 of the cylinder 100 is of conical configuration so as to define an annular conical seat 150 for the seating of a downwardly extending inverted cup portion 151 of a flush valve piston 152. The cup portion of the piston 152 is provided with an annular groove 156 for the acceptance of an O-ring 158 that is normally seated on the annular conical seat 150 of the cylinder 100.

The inverted cup portion 151 of the piston 152 is connected to a head portion 160 thereof by an intermediate neck portion 161. The piston head portion 160 has an annular groove 162 therein for the acceptance of an annular lip seal 164, of U-shaped radial cross section, that effects slidable sealing engagement between the piston 152 and an inside wall 166 of the cylinder 100.

The piston 152 is normally biased downwardly relative to the cylinder 100 to the position shown in FIG. 5 by a compression spring 170. In this condition, the O-ring 158 on the inverted cup 151 portion of the piston 152 is seated against the annular conical seat 150 on the cylinder 100, sealing the accumulator vessel 14 against the discharge of water therefrom.

In accordance with one feature of the present invention, the head portion 160 of the piston 152 divides the cylinder 100 into an upper chamber 172 between the head 160 and end cap 112 and a lower chamber 174 underlying the head 160. Fluid flow communication is provided between the upper chamber 172 and lower chamber 174 by a vertically extending unvalved orifice 180 in the head portion 160 of the piston 152. The cross-sectional area of the orifice 180 is carefully controlled during manufacture of the flush system 10 since it controls operation of the flush valve assembly 16, as will be described.

As best seen in FIG. 4, the upper end cap 112 on the cylinder 100 is provided with a vertical bore 190 for the acceptance of the vacuum breaker assembly 20. The assembly 20 comprises a cylindrical cartridge 192 for the journaling of a vertically movable mushroom valve 194. The valve 194 is normally biased against a conical seat 196 on the cartridge 192 by a helical compression spring 198, thereby to preclude passage of air outwardly of the upper chamber 172 of the flush valve cylinder 100 under normal operating conditions. However, in the event that an air pressure differential develops across the valve 194, wherein air pressure externally of the vessel 14 is greater than air pressure internally thereof, the valve 194 opens to admit atmospheric air precluding spurious opening of the flush valve 16 and syphoning of contaminated water into the water supply.

In accordance with another feature of the invention and as best seen in FIG. 5, upward movement of the piston 152 and cup valve 151 thereon is aided by a skirt 200 on the cup valve 151, which, because it partially blocks the discharge orifice 129 at the lower end 128 of the cylinder 100, is hydraulically pushed upwardly by the pressurized water ejected from the accumulator vessel 14.

The flush control valve 22 used to initiate flushing of the system 10 is of conventional construction, for example, a Model 190-0 push button valve obtainable from Mansfield Plumbing Products, Perrysville, Ohio. The valve 22 is connected directly to the upper end cap 112 of the flush valve cylinder 100 by the conduit 116. When opened, the control valve 22 allows the compressed air and any water in the upper chamber 172 of the flush valve cylinder 100 to be expelled, initially by the expansion of air in the upper chamber 172 and subsequently by upward movement of the piston 152 due to the resultant pressure differential thereacross.

The outlet of the control valve 22 is connected by a conduit 192 back to the accumulator vessel 14 at a point below the outlet seal 158 on the inverted cup valve 151 or to the interior of the water closet 12 for venting to the toilet bowl thereby to pass any liquid discharged from the upper chamber 172 of the flush valve 16 directly into the toilet bowl.

As seen in FIG. 6, a modified flush valve assembly 201 is designed for use with a flushometer-tank of earlier design of the type taught in my U.S. Pat. No, 4,233,698. The flush valve assembly 201 comprises a vertically orientated flush valve cylinder 202 having a shoulder 204 intermediate the ends thereof that is seated on a bushing 206. The bushing 206 has an externally threaded portion 208 that extends through an aperture 210 in the accumulator vessel 14. The bushing 206 accepts a combination nut and bushing extension 212. Suitable gaskets 214 and 215 effect a seal between the accumulator vessel 14 and bushing 206 and between the vessel 14 and extension 212, respectively. The bushing extension 212 extends downwardly into seating engagement with a water closet bowl 216.

In operation, water under system pressure is supplied to the flushing system 10 through the water inlet tube 26, line 30, water and water and air induction assembly 18, into the accumulator vessel 14. As the water level rises in the accumulator vessel 14, air trapped therein is compressed until the pressure thereof equals that of the fresh water supply.

The water discharge phase of the flush cycle is initiated when the flush control 22 is actuated, compressed air in the upper valve chamber 172 above the piston 152 is vented to atmosphere allowing the piston 152 to move upwardly against the bias of the spring 170 due to the pressure differential thereacross. As the piston 152 and cup valve 151 thereon move upwardly, water stored in the accumulator vessel 14 discharges through the apertures 130 and 132 in the cylinder 100 flowing downwardly past the inverted cup valve 151 on the piston 152 and downwardly into the water closet bowl.

At such time as the water level in the accumulator 14 reaches the top of the openings 130 and 132 in the cylinder 100, the pressure differential across the piston 152 is dissipated due to air flowing through the openings 130 and 132 in the cylinder 100, thence through the aperture 180 in the piston whereupon the flush valve spring 170 is capable of biasing the piston 152 and its associated valve downwardly to effect seating of the O-ring 158 thereof against the valve seat 150 on the lower end of the cylinder 100, terminating flow of water into the water closet bowl. It is to be noted that the aforesaid operating procedure does not require total exhaust of water from the accumulator vessel 14 but, in contradistinction, termination of flush action is positively controlled by the rate that the air pressure differential across the piston 152 is dissipated, which, in turn, is controlled by the area of the orifice 180 in the piston 152. The closure rate of the valve 151 can be controlled by varying size of transfer orifice 180. The larger the orifice 180, the faster the pressure differential is attenuated and the faster the flush valve 151 will close. Conversely, a smaller orifice 180 delays closure of the valve 151.

After termination of the water discharge phase of the flush cycle, the water supply in the accumulator vessel 14 is replenished from the water supply system. Water flows through the inlet tube 26 and line 30 to the water and air induction assembly 18. As water flows past the tube extension 74 in the air induction assembly 18, any air pressure differential across the valve 64 effects movement thereof against the bias of the spring 168 opening the valve 62. Air is induced into the water stream to replenish the supply of air in the accumulator vessel 14. Replenishment is self-controlled, due to the fact that when adequate air is introduced into the accumulator vessel 14, compression thereof will effect closure of the valve 62.

From the foregoing it should be apparent that the water closet flushing system of the present invention constitutes an improvement over known systems by maintaining water pressure in the accumulator 14 above ambient pressure throught the water discharge phase until the piston 152 and valve 151 thereon are biased to the closed condition by spring 170. Stated in another manner, the water level in the accumulator 14 is not lowered to the level of the valve seat 150 prior to closure of the valve 151.

While the preferred embodiment of the invention has been disclosed, it should be appreciated that the invention is susceptible of modification without departing from the scope of the following claims.

I claim:

1. A pressurized water closet flushing system having a flush cycle comprising a water discharge phase and a water fill phase, said system comprising:

an accumulator vessel for storing water and air above ambient pressure and maintaining above ambient air pressure on said water throughout the water discharge phase of the flush cycle;

a water inlet in said accumulator vessel connected to and open at all times to a source of water under pressure;

a water outlet from said vessel;

an air pressure differential actuated flush valve assembly for controlling the discharge of water from said water outlet comprising:

a cylinder extending vertically above the water outlet in said vessel and having a lower end in fluid communication with the outlet of said vessel;

a vertically movable piston having an annular seal on its outer periphery slidably engaged with an inner wall of said cylinder and defining upper and lower chambers therein, the upper chamber in said cylinder having a normally closed air discharge outlet therein;

a permanently open air metering orifice in said piston providing communication between the upper and lower chambers of said cylinder;

an aperture in said cylinder providing fluid communication between the interior of said accumulator vessel and the lower chamber in said cylinder;

a valve on said piston normally closing said water outlet and operable upon upward movement of said piston to permit the discharge of water through said outlet;

a spring normally biasing said piston and the valve thereon downwardly to the closed condition; and a normally closed flush valve actuator operable to open communication between the air discharge outlet in the upper chamber of said cylinder and ambient air pressure thereby to create an air and water pressure differential across said piston having an upward bias thereon to effect upward movement of said piston and opening of said valve while maintaining above ambient air pressure within said vessel to facilitate discharge of water therefrom under pressure greater than ambient; closure of said actuator effecting closure of the upper chamber of said cylinder whereby downward movement of said piston under the bias of said spring is attenuated by the creation of a pressure differential across said piston having an upward bias on said piston, the pressure differential across said piston being dissipated by the flow of air upwardly through the metering orifice therein so as to condition said piston for downward movement under the bias of said spring and closure of said valve after a predetermined time period.

2. A pressurized water closet flushing system having a flush cycle comprising a water discharge phase and a water fill phase, said system comprising;

an accumulator vessel for storing water and air above ambient pressure;

a water inlet in said accumulator vessel connected to and open to a source of water under pressure;

a water outlet from said vessel;

an air pressure differential actuated flush valve assembly for controlling the discharge of water from said water outlet comprising:

a cylinder extending vertically above the water outlet in said vessel and having a lower end in fluid communication with the outlet of said vessel;

a vertically movable piston having an annual seal on its outer periphery slidably engaged with an inner wall of said cylinder and defining upper and lower chambers therein, the upper chamber in said cylinder having a normally closed air discharge outlet therein;

an air metering orifice in said piston providing communication between the upper and lower chambers of said cylinder;

an aperture in said cylinder providing fluid communication between the interior of said accumulator vessel and the lower chamber in said cylinder;

a valve on said piston normally closing said water outlet and operable upon upward movement of said piston to permit the discharge of water through said outlet;

a spring normally biasing said piston and the valve thereon downwardly to the closed condition; and a normally closed flush valve actuator operable to open communication between the air discharge outlet in the upper chamber of said cylinder and ambient air pressure.

* * * * *

UNITED STATES PATENT AND TRADEMARK OFFICE

CERTIFICATE OF CORRECTION

PATENT NO. : 6,360,378 B2
DATED : March 26, 2002
INVENTOR(S) : Martin

It is certified that error appears in the above-identified patent and that said Letters Patent is hereby corrected as shown below:

Column 6,
Line 47, please delete “throught” and replace with -- through --

Signed and Sealed this

Twenty-third Day of July, 2002

*Attest:*

*Attesting Officer*

JAMES E. ROGAN
*Director of the United States Patent and Trademark Office*